United States Patent [19]

Chen et al.

[11] 4,446,004

[45] May 1, 1984

[54] PROCESS FOR UPGRADING VACUUM RESIDS TO PREMIUM LIQUID PRODUCTS

[75] Inventors: Nai Y. Chen, Titusville; Lillian A. Rankel, Princeton; Leslie R. Rudnick, Trenton, all of N.J.

[73] Assignee: Mobil Oil Corporation, New York, N.Y.

[21] Appl. No.: 452,529

[22] Filed: Dec. 23, 1982

[51] Int. Cl.[3] ..... C10G 69/06

[52] U.S. Cl. ..... 208/57; 208/61; 208/89

[58] Field of Search ..... 208/57, 58, 59, 61, 208/89

[56] References Cited

U.S. PATENT DOCUMENTS

| | | | |
|---|---|---|---|
| 3,511,771 | 5/1970 | Hamner | 208/89 |
| 3,594,309 | 7/1971 | Stolfa | 208/89 |
| 3,598,721 | 8/1971 | Haensel | 208/89 |
| 3,855,113 | 12/1974 | Gould | 208/89 |
| 4,061,562 | 12/1977 | McKinney et al. | 208/61 |
| 4,062,757 | 12/1977 | Beuther et al. | 208/61 |
| 4,181,601 | 1/1980 | Sze | 208/143 |
| 4,216,077 | 8/1980 | Chaavekilian et al. | 208/57 |
| 4,310,409 | 1/1982 | Wernicke et al. | 208/57 |

*Primary Examiner*—Delbert E. Gantz
*Assistant Examiner*—O. Chaudhuri
*Attorney, Agent, or Firm*—Michael G. Gilman; Alexander J. McKillop; Michael G. Gilman

[57] ABSTRACT

An improved process for upgrading vacuum resids to premium liquid products which comprises mild hydrotreating of the vacuum resids followed by fractionating and short contact time thermal cracking of the fraction boiling above 850° F.+, such as by short contact time thermal cracking or rapid pyrolysis.

9 Claims, 3 Drawing Figures

PROCESSING SCHEMES FOR ARAB HEAVY RESID

COKE/CCR RELATIONSHIP FOR ARAB HEAVY HYDROTREATED 850°F+ RESID

PROCESS FOR UPGRADING VACUUM RESIDS TO PREMIUM LIQUID PRODUCTS

BACKGROUND OF THE INVENTION

1. Field of the Invention

This invention relates to a combination of mild hydrotreating and rapid thermal cracking of a vacuum resid. It especially relates to fluid bed coking or rapid pyrolysis for carrying out the thermal cracking.

2. Review of the Prior Art

Residual petroleum oil fractions, such as those heavy fractions produced by atmospheric and vacuum crude distillation columns, are typically characterized as being undesirable as feedstocks for most refining processes, due primarily to their high metals and sulfur content.

Principal metal contaminants are nickel and vanadium, with iron and small amounts of copper also sometimes being present. Additionally, trace amounts of zinc and sodium are found in most feedstocks. As the great majority of these metals, when present in crude oil, are associated with very large hydrocarbon molecules, the heavier fractions produced by crude distillation contain substantially all of the metals present in the crude, such metals being particularly concentrated in the asphaltene residual fraction and associated with large organo-metallic complexes such as metalloporphyrins and similar tetrapyrroles.

The residual fraction of single stage atmospheric distillation and two-stage atmospheric/vacuum distillation also contains the bulk of the crude components which deposit as carbonaceous or coke-like material on cracking catalysts without substantial conversion. These are frequently referred to as "Conradson Carbon" from the analytical technique of determining their concentration in petroleum fractions.

Coking is one of the refiner's major processes for converting residuals to lighter, more valuable stocks. Petroleum coke is the residue resulting from the thermal decomposition or pyrolysis of high-boiling hydrocarbons, particularly residues obtained from cracking or distillation of asphaltenic crude distillates. The hydrocarbons generally employed as feedstocks in the coking operation usually have an initial boiling point of about 380° C. (700° F.) or higher, an API gravity of about 0° to 20°, and a Conradson Carbon residue content (CCR) of about 5 to 40 weight percent.

The coking process is particularly advantageous when applied to refractory, aromatic feedstocks such as slurry decanted oils from catalytic coking and tars from thermal cracking. In coking, the heavy aromatics in the resid are condensed to form coke. During coking, about 15–50 wt.% of the charge goes to form coke. The remaining material is cracked to naphtha and gas oil which can be charged to reforming and catalytic cracking.

Hydrotreating resids before coking has long been practiced in order to desulfurize and/or demetalize the resid and produce higher-grade products, especially purer coke that is useful for making electrode carbons. For example, U.S. Pat. No. 2,963,416 describes a process in which 1–20 moles of hydrogen per mole of feed are added at 200–1000 psi and 300°–1200° F., suitably using a cobalt-molybdenum catalyst on alumina. The metals are deposited on the catalyst. After fractionating, coking is done at 750°–900° F. and 15–200 psig. Coke makes of 28% and 39% are described.

U.S. Pat. No. 2,871,182 discloses a process for mildly hydrogenating a resid and coking the hydrogenated material. A mixture of resid and 1.5–25 mols hydrogen per mol resid (approximately 300–5000 scf $H_2$/bbl feed) is reacted at 600°–800° F., 100–3000 psi, and 0.1–10 space velocity and is then coked at 800°–1200° F., 0–3000 psi, and with 0–5000 scf/bbl $H_2$ to produce a fine, granular coke which is in slurry form and at least partially desulfurized.

U.S. Pat. No. 3,617,481 relates to a combination of coking and hydroprocessing of a resid having a high Conradson Carbon content and a high metals content in which the coke produced serves as catalyst base for the hydroprocessing step. Hydrotreating occurs at 725°–950° F. and 800–3000 psi if cracking is desired or at 550°–800° F. and 600–1500 psi if only desulfurizing is desired, using 1000–5000 scf/bbl $H_2$. The coke make is typically 45–55% by weight, using fluidized coking.

U.S. Pat. No. 3,891,538 relates to hydrodesulfurizing an atmospheric resid, fractionating the product, and coking a mixture of the +1000° F. product and decant oil produced by catalytically cracking the 650°–1000° F. fraction and then fractionating the cracked product to obtain the decant oil as the bottoms. Increased yields of gasoline and jet fuel are obtained.

Other processes for hydrotreating followed by delayed coking are given in U.S. Pat. Nos. 3,773,653, 3,902,991 and 4,235,703. U.S. Pat. No. 3,773,653 is particularly interesting in that it uses a three-phase ebullient bed reaction zone for hydrotreating a resid at 1500–3000 psi, 750°–840° F., an LHSV of 0.3–1.5 volumes of feed/hr/volume of reactor with a suitable hydrotreating catalyst. It was found that between 30% and 60% conversion occured with sulfur and vanadium at minimum levels in the coke. Coking produced 30% coke from virgin vacuum resid and 30% from a 475° F. fraction therefrom, equalling 13.5% of the original feed.

U.S. Pat. No. 4,235,703 relates to delayed coking of vacuum resids after catalytically demetalizing and then catalytically desulfurizing. Catalytic demetalation occurs over a vanadium-promoted alumina catalyst at at least 725° F., a pressure of at least 1067 psi, an LHSV of no more than 0.25, and a hydrogen rate of 500–1000 standard cubic feet/bbl of feed.

U.S. Pat. No. 4,062,757 describes a thermal cracking process for resids by upflow with hydrogen through a packed bed of inert, non-catalytic, non-porous solids, preferably at 790°–950° F., 100–2500 psi, a hydrogen flow rate of 500–2500 scf/bbl and an oil residence time of 0.3–3 hours. If hydrodesulfurization is desired, a catalyst comprising at least one Group VI metal and at least one Group VIII metal on a non-cracking support, such as alumina, is used.

In general, if a resid is thoroughly demetalized and desulfurized, reaction conditions must be quite severe and hydrogen consumption must be large. Demetalization particularly requires a high temperature unless a specific catalyst is utilized, such as a large-pore catalyst for demetalation followed by a small-pore catalyst for desulfurization, as disclosed in U.S. Pat. No. 4,054,508.

Thereafter, when the hydrotreating has been followed by coking, there has generally been some improvement in yield of liquid products and, of course, a greatly improved quality of coke. However, the cost of operating at relatively high temperatures and pressures and especially the cost of hydrogen consumption has largely minimized the usage of such processes.

It would normally be expected that coking a hydrotreated resid would produce greatly improved liquid yields at the expense of the coke make. However, this desirable result occurs only to a limited extent and, although there is increased saturation of products, much of the newly acquired hydrogen appears to be readily split from the hydrotreated resid when it is exposed to the high temperatures of coking. Moreover, the thermally cracked liquid products from the coker have a higher molecular weight than is desirable, thus minimizing the coker naphtha yield in favor of the heavier coker gas oils. Another undesirable result of many of the prior art processes is that the metal contaminants tend to be deposited on the catalyst, thereby forcing expensive replacement and/or regeneration thereof.

There is, accordingly, a need for a process in which a minimum of hydrogen is used to produce a maximum of lower-boiling liquid products and a minimum of coke containing as much of the contaminants as possible in order to isolate these contaminants from the catalyst and the hydrocarbon products that are desired.

SUMMARY OF THE INVENTION

It is an object of this invention to provide a process for mild hydrotreating and short contact time pyrolysis of a resid that utilizes a minimum of hydrogen and produces a minimum of coke and a maximum of liquid products at ambient temperature.

It is another object to produce lower-boiling distillates in the gasoline range as a larger than customary proportion of these coker distillates.

It is also an object to minimize the deposition of metal contaminants on the hydrotreating catalyst and to concentrate the contaminants within the coke.

In accordance with these objects and the principles of this invention, it has surprisingly been discovered that by exposing a slightly hydrotreated resid to brief, short-time processing at high temperatures, thermal cracking occurs before or without substantial splitting off of hydrogen to produce products that, although largely unsaturated, do not re-combine to produce hydrocarbons of heavier molecular weight so that at ambient temperatures these products are largely unsaturated liquids within the gasoline boiling range.

It has also been found that there is no specific quantity of hydrogen to be added for any and all resids but that each resid needs an individually determined quantity of hydrogen, depending upon its asphaltene content, CCR content, and the like in order to add hydrogen atoms at the critical molecular positions but not at most of the unsaturated positions. For example, the hydrogen need of some resids may be no more than 200 scf/bbl whereas others may be as high as 1500 scf/bbl. An example of the relationship of CCR and asphaltene contents to hydrogen need is approximately as follows:

| Arab Heavy 950° F.+ | | | 850° F.+ Hydrotreated Fraction | |
|---|---|---|---|---|
| % CCR | % Asphaltene | H-Consumption SCF/B | % CCR | % Asphaltene |
| 19.8 | 23.2 | 808 | 12.6 | 2.9 |
| 19.8 | 23.2 | 1394 | 10.8 | 2.2 |

The hydrotreating that occurs is consequently mild and should result in adding about 0.1–3.0 mols of $H_2$ per mol of average resid. For a feed of approximate CCR and asphaltene varying from 2 to 30 wt.%, the amount of added $H_2$ should range from 200 to 1500 scf/bbl.

It has further been found to be critically important that the thermal cracking operation must be sufficiently intense and brief to enable thermal cracking to occur without an opportunity for the cracked products to recombine into larger molecular structures. Without desiring to be held to a particular theory, it is believed that by adding a carefully limited quantity of hydrogen and heating for a sufficiently brief period, metal-organic linkages with tetrapyrrole structures are unlikely to be broken but carbon-oxygen bonds and carbon-nitrogen bonds are sundered fairly readily and alkyl chains bonded to ring structures are broken away and then reformed as highly olefinic structures of low molecular weight.

The temperature and duration of exposure to thermal cracking are critical. In other words, short residence time pyrolysis is needed. Hot moving solid particles within the pyrolysis unit and/or moving gases, including steam, can help accomplish the heat transfer needed for this rapid pyrolysis.

By the methods of this invention, a surprisingly large proportion of resids are split into lower molecular weight compounds in the gasoline boiling range and a surprisingly small proportion are condensed into coke without transfer of metal contaminants onto the hydrotreating catalyst. These desirable results occur without significant desulfurization or demetalation and without consuming large amounts of hydrogen.

A useful measure of the effectivenss of the invention is the ratio of coke/CCR, both expressed as weight percentages. For coking of straight run resids, this ratio can vary from 1.4 to 2.0. Comparative ratio values are 1.55 for fluid coking as compared to 2.00 for delayed coking of a straight run Arab heavy resid boiling at 1075° F.+. Reducing the residence time of thermal contacting by rapid pyrolysis without hydrotreating only makes small improvements.

The benefit from this invention is the surprisingly reduced value for coke/CCR of 0.6–0.9 obtained when rapidly pyrolyzing the hydrotreated 850° F.+ resid as compared to a coke/CCR ratio of 1.6–3.0 for delay coking the hydrotreated 850° F.+ resid.

The important point in this invention is that mildly hydrotreated 850° F.+ resid that is rapidly pyrolyzed gives a coke/CCR ratio of 0.6–0.9, whereas the same mildly hydrotreated 850° F. resid that is delay coked gives a coke/CCR ratio of 1.7–3.0. The ratio range of 0.6–0.9 is an unexpectedly low coke/CCR ratio which leads to a significant increase in liquid yield for the processing scheme shown in FIG. 3. Another important point is that when mild hydrotreating is used, i.e., H-consumption under 1500 SCF/BBL can be obtained by using a catalyst that hydrotreats but does not demetalate. Demetalation is not necessary in order to obtain significantly less coke make when rapid pyrolysis of a mildly hydrotreated resid is used. However, H-content enrichment is needed in order to obtain the reduced coke make when rapidly pyrolyzing the mildly hydrotreated 850° F.+ material.

The process of this invention for producing high liquid yields in the gasoline boiling range and low coke yields from asphaltene-containing residual oils may be summarized as comprising:

A. lightly hydrotreating the residual oils;

B. fractionating the lightly hydrotreated residual oils and removing a fraction boiling at at least 800° F. at atmospheric pressure; and C. thermally cracking the 800° F.+ fraction during a period of 1 to 10 seconds.

The fraction of step B preferably boils at at least 850° F. The lightly hydrotreating step comprises passing hydrogen through the oils at a circulation rate of 1000 to 10,000 scf/bbl of the residual oils at 650° to 750° F. and an LHSV of 0.1 to 10.0. The lightly hydrotreating step is preferably performed at 750° F. and an LHSV of 0.3. The CCR of the lightly hydrotreated oils is 5–15 wt.%. Preferably, the thermal cracking step is performed by rapid pyrolysis at a coking temperature of 900° to 1100° F. The rapid pyrolysis produces a coke/CCR ratio of 0.5 to 1.3.

DESCRIPTION OF THE PREFERRED EMBODIMENTS

Figure 1:
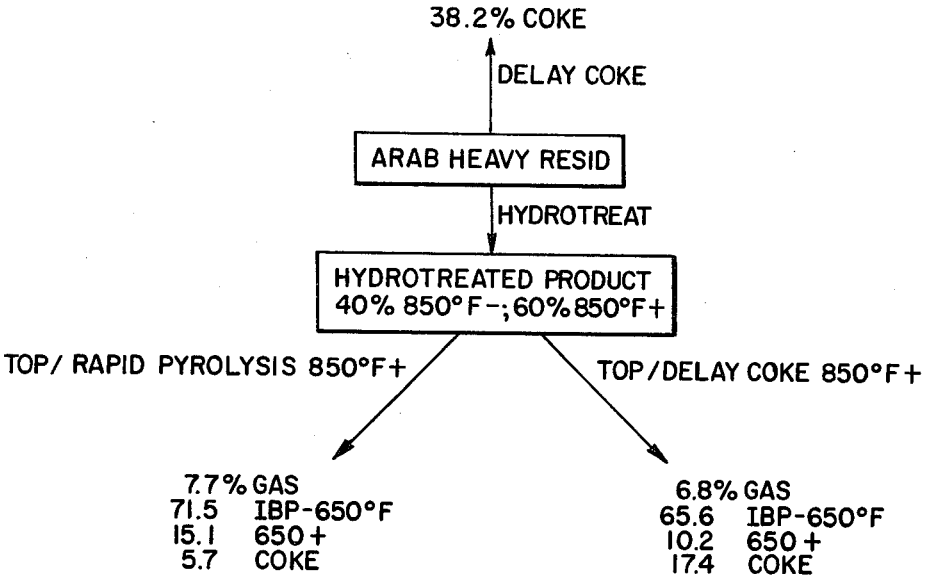
FIG. 1 is a schematic flowsheet that illustrates comparative processing schemes for an Arab Heavy Resid by comparing coke production from delay coking of the whole resid without mild hydrotreating and with hydrotreating after topping and then by comparing both results with rapid pyrolysis after topping of the mildly hydrotreated resid.

In general, the hydrotreating of this invention is as mild as possible, comprising hydrotreating at temperatures of 600° to 750° F. under a hydrogen pressure of 300 to 2000 psi, an LHSV of 0.1 to 10, and a hydrogen circulation rate of about 1000 to 10,000 scf/bbl of feed in order to remove as little sulfur and metals as possible. At the same time, this mild hydrotreating transfers a minimum of sulfur and metals to the catalyst, leaving a maximum amount thereof in the mildly hydrotreated resid which can be separately treated for their removal to the extent indicated by market conditions and environmental regulations.

In the first four of the following examples, the hydrotreating is mild but not of ideal mildness. In Examples 5–7, hydrotreating approaches ideal mildness as indicated by the very low removals of metals and sulfur.

Short-contact time pyrolysis, as indicated in the examples, can be performed in a number of ways, provided that the time at cracking temperatures is quite brief, the hotter being the temperature, the briefer being the cracking time.

EXAMPLES

Examples 1–4 are comparative examples describing delayed coking and rapid pyrolysis of an Arab heavy resid and a fraction thereof after lightly hydrotreating. As illustrated schematically in FIG. 1, the Arab heavy resid, having a boiling point at atmospheric pressure of at least 1075° F., enters the process through line 11, passes through line 13 to heater 15, and enters delayed coker 19 through line 17 from which liquids and gaseous products leave through line 21 and coke leaves through line 23; coker 19 produces 38% coke and 57% liquids. This process is described in Example 1.

The heated resid alternatively flows from line 17 through line 25 to rapid pyrolysis unit 27 from which gas and liquids leave through line 29 and coke leaves through line 31; coker 27 produces 30% coke and 65% liquid. This process is described in Example 2.

Alternatively, the Arab heavy resid in line 11 enters hydrotreater 35 where it is lightly hydrotreated to reduce its CCR from 19.1% to 10.8%. The lightly hydrotreated resid next passes through line 37 to fractionator 39 from which fractions leave through lines 41,43, and 45. The fraction in line 45 has a boiling point of at least 850° F. at atmospheric pressure and enters heater 47. Leaving through line 49, the lightly hydrotreated fraction enters delayed coker 51 from which gases and liquids leave through line 53 and coke leaves through line 55; coker 51 produces 29% coke and 68% liquids. This process is described in Example 3.

Alternatively, the lightly hydrotreated resid fraction passes from line 49 into line 57 to enter rapid pyrolysis unit 59 from which gases and liquids leave through line 61 and coke leaves through line 63; rapid pyrolysis unit 59 produces less than 10% coke and 86% liquids. This process is described in Example 4.

EXAMPLE 1

A sample of an Arab heavy vacuum resid, having a CCR of 19.1%, was charged to a 40 ml cylindrical stainless steel Hoke vessel in air. The vessel was then positioned horizontally in a fluidized sand bath and maintained at 850° F. for 20 hours for delayed coking. The outlets of the reactor were connected to a gas burette and to a trap for liquid products. The liquid trap was maintained at −68° F., using dry ice. All liquids were found to have distilled out of the reactor and were collected in this trap.

Gases and liquids boiling within the range of initial boiling point (IPB) to 1075° F., were analyzed by gas chromatography. Coke was determined by the difference between the weight of the reactor after use minus the weight before use. The coke was toluene insoluble. The results are shown in Table 1.

EXAMPLE 2

The heated Arab heavy resid of Example 1 was pyrolyzed at 950° F. in a vycor 40/80 mesh fluidized bed. This bed contained 50 grams of vycor and the feed rate was 50 cc/hr. Helium was used to fluidize the bed and flowed at 850 cc/minute, giving a residence time for the resid of 1 second. Gas and liquids were collected. Coke was determined by monitoring the $CO_2$ generated by burning the coke off the vycor. The results are shown in Table 1.

TABLE 1

ANALYSES OF ARAB HEAVY RESID FEED AND COKED PRODUCTS BEFORE AND AFTER HYDROTREATING

| | Arab Heavy Resid | | | Arab Heavy Hydrotreated Resid | | |
|---|---|---|---|---|---|---|
| | Feed | Delay Coked Examples 1 | Rapid Pyrolysis Examples 2 | Feed | Delay Coked Examples 3 | Rapid Pyrolysis Examples 4 |
| PRODUCTS: | | | | | | |
| Gas | | 4.6 | 4.97 | | 3.25 | 4.58 |
| Liquid | | 57.2 | 65.37 | | 67.87 | 85.88 |
| Coke | | 38.2 | 29.66 | | 28.88 | 9.55 |
| BOILING RANGE DISTRIBUTION: | | | | | | |
| Gas | | 4.6 | 4.97 | | 3.25 | 4.58 |
| IBP-420 | | 16.3 | 9.39 | | 16.99 | 30.82 |
| 420-650 | | 26.5 | 24.43 | | 33.91 | 29.96 |
| 650+ | | 14.4 | 31.62 | | 16.97 | 25.10 |
| Coke | | 38.2 | 29.66 | | 28.88 | 9.55 |
| LIQUID ANALYSIS: | | | | | | |
| % C | 85.11 | 85.04 | 82.62 | 87.55 | 87.14 | 86.64 |
| H | 10.16 | 12.58 | 11.00 | 11.70 | 12.97 | 12.04 |
| N | 0.43 | 0.044 | 0.30 | 0.26 | 0.032 | 0.22 |
| O | 0.46 | 0.77 | 1.86 | <0.5 | 0.02 | 0.48 |
| S | 5.24 | 2.20 | 4.07 | 0.73 | 0.31 | 0.45 |
| ppm Ni | 60 | | 2 | 12 | | 2 |
| V | 160 | | <5 | 14 | | <5 |
| % CCR | 19.1 | | | 10.8 | | |
| % Asphaltenes | 23.3 | | | 2.2 | | |
| Coke/CCR | | 2.00 | 1.55 | | 2.69 | 0.89 |
| Coke/TGA Char | | 2.38 | 1.85 | | 3.39 | 1.11 |

EXAMPLE 3

The Arab heavy vacuum resid of Examples 1 and 2, having a CCR of 19.1%, was hydrotreated by flowing hydrogen therethrough at 730° F., using 2000 psig of hydrogen. The lightly hydrotreated resid was then separated in a fractionator, and the bottoms fraction boiling above 850° F. was heated and added to the delayed coker described in Example 1. Liquids and coke were collected and measured as described in Example 1. The results are shown in Table 1.

EXAMPLE 4

The lightly hydrotreated Arab heavy resid fraction described in Example 3 was fed to the rapid pyrolysis unit described in Example 2, and the gases and liquids were collected, coke being similarly determined by monitoring the $CO_2$ generated by burning the coke off the vycor. The results are shown in Table 1.

Figure 2:
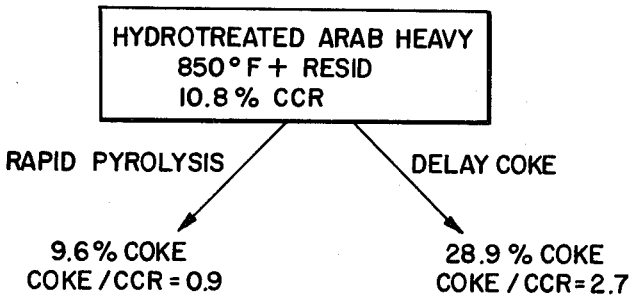
FIG. 2 is a schematic comparison of the coke/CCR relationship for the mildly hydrotreated Arab heavy resid after rapid pyrolysis and after delay coking.
Figure 3:
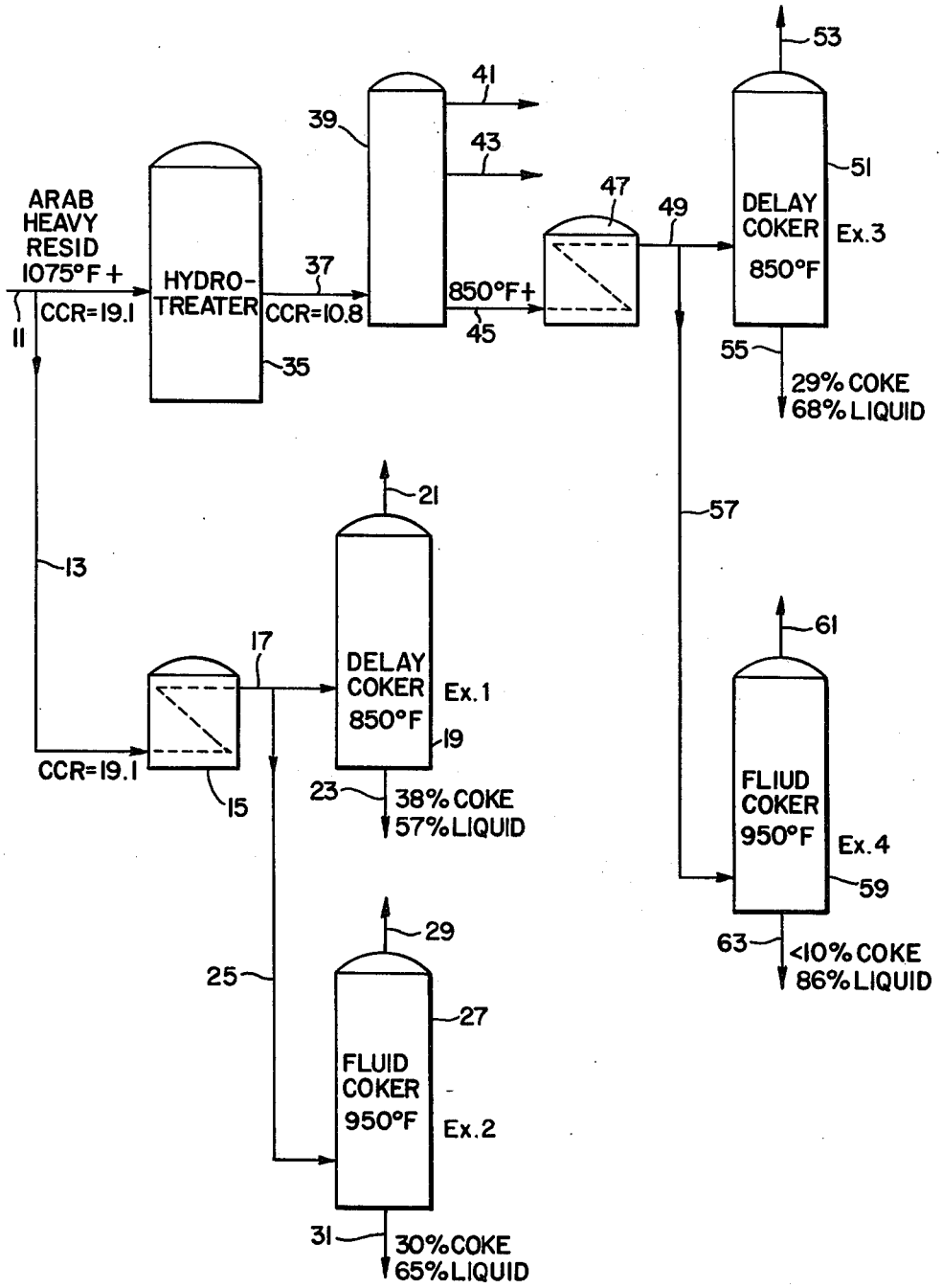
FIG. 3 shows a schematic process that illustrates the comparative testing described in Examples 1–4.

Review of the data in Examples 1 to 4 shows that combining hydrotreating with delayed coking gave only a marginally improved product slate over the raw resid. On the other hand, rapid pyrolysis of the hydrotreated 850° F.+ resid produced a great advantage in liquid yield compared to delayed coking, and more rapid pyrolysis product was in the gasoline boiling range. This result is believed to be unpredictable from prior art knowledge of the comparative effects of delayed coking and rapid pyrolysis. FIGS. 1 and 2 furnish schematic representations of these concepts. Thus from FIGS. 1 and 2, it can be seen that the coke/CCR ratio is surprisingly low when rapid pyrolysis of a 850° F.+ hydrotreated resid is effected. Note that the coke/CCR ratio for delay coking this 850° F.+ hydrotreated resid is 2.7.

EXAMPLE 5

An Arab Light vacuum resid, having a atmospheric boiling point of 1075° F.+, a CCR of 17.0%, an asphaltene content of approximately 18%, and 10.6% hydrogen, is mildly hydrotreated with 800 scf $H_2$/bbl feed at 750° F. for approximately 20 minutes, using 0.4 LHSV and 2000 psi of hydrogen pressure. The CCR is reduced to 8.7%. The hydrotreated material is fractionated to produce a bottoms fraction boiling above 950° F. which is then delayed coked as described in Examples 1 and 3 and rapidly pyrolyzed as described in Examples 2 and 4. The hydrotreated bottoms fraction had a metal (Ni+V) content of 10 ppm, as compared to 85 ppm (Ni+V) for the resid. The liquids and coke produced were respectively 71 and 26 from delayed coking and 87 and 9 from rapid pyrolysis. The coke/CCR ratios are ~1.8 and 2.6 for delayed coking before and after hydrotreating and 1.2 and 0.9 for rapid pyrolysis before and after hydrotreating. The results are shown in Table 2.

EXAMPLE 6

An Arab Heavy-Medium vacuum resid, having a boiling point of above 850° F.+, a CCR of 20%, an asphaltene content of 21%, and 10.04% hydrogen, is mildly hydrotreated with 2000 scf $H_2$/bbl feed at ~730° F. using 0.3 LHSV and 2000 psi of hydrogen pressure. The CCR is thereby reduced to 9.9% in the 950° F.+ portion.

TABLE 2

ARAB LIGHT VACUUM RESID BASED FEED

| | Arab Light Vacuum Resid 1075° F.+ | Arab Light Hydro-treated Resid | Bottoms From Arab Light Hydrotreated Resid 850° F.+ Feed | Delay Coked | Rapid Pyrolysis |
|---|---|---|---|---|---|
| Products: | | | | | |
| gas | | | | ~3.0 | ~4.0 |
| liquid | | | | ~71 | ~87.1 |
| coke | | | | ~26 | ~8.9 |
| Liquid Analysis: | | | | | |
| % C | | | | | |

TABLE 2-continued

| ARAB LIGHT VACUUM RESID BASED FEED | Arab Light Vacuum Resid 1075° F.+ | Arab Light Hydro-treated Resid | Bottoms From Arab Light Hydrotreated Resid 850° F.+ Feed | Delay Coked | Rapid Pyrolysis |
|---|---|---|---|---|---|
| H | 10.6 | 11.8 | | | |
| N | 0.28 | 0.21 | | | |
| O | | | | | |
| S | 4.0 | 0.87 | | | |
| ppm Ni | 16 | 2.6 | ~6 | | |
| V | 69 | 1.6 | ~4 | | |
| % CCR | 17.0 | 8.6 | ~10 | | |
| $H_2$ Consumption, SCF/BBL | | 876 | | | |
| % Asphaltenes | ~18 | | | | |
| Estimated: | | | | | |
| Delay Coke Make | 26 | | | | |
| Fluid Coke Make | 9 | | | | |
| Coke/CCR | | | | 2.6 | 0.89 |

The hydrotreated material is fractionated to produce a bottoms fraction boiling above 850° F. which is then delayed coked as described in Examples 1 and 3 and rapidly pyrolyzed as described in Examples 2 and 4. The hydrotreated bottoms fraction has a nickel content of 16 ppm, as compared to 45 ppm for the resid, and a vanadium content of 27 ppm, as compared to 150 ppm of the resid. The liquids and coke produced are respectively 80.9 and 16.0 from delayed coking and 93.2 and 5.9 from rapid pyrolysis. The coke/CCR ratios are 1.9 and 1.6 for delayed coking before and after hydrotreating and 1.5 and 0.6 for rapid pyrolysis before and after hydrotreating. The results are shown in Table 3.

EXAMPLE 7

A Kuwait Atmospheric Resid, having an atmospheric boiling point of 650° F.+, CCR of 8.0%, an asphaltene content of 4.0%, and 11.6% hydrogen content, is mildly hydrotreated with 600 scf $H_2$/bbl consumption at 725° F., 0.75 LHSV, and 2000 psi of hydrogen pressure. The CCR is thereby reduced to 3.4%. The hydrotreated material is fractionated to produce a bottoms fraction boiling at at least 850° F. which is then delayed coked as described in Examples 1 and 3 and rapidly pyrolyzed as described in Examples 2 and 4. The hydrotreated bottoms fraction has a nickel content of 2.0 ppm, as compared to 11 ppm for the resid, and a vanadium content of 4.0 ppm, as compared to 40 ppm in the resid. The liquids and coke produced are respectively 87% and 10% from delayed coking and 93% and 3% from rapid pyrolysis.

TABLE 3

| ARAB HEAVY MEDIUM RESID BASED FEED | Arab Heavy Medium Resid | Arab Heavy Medium Hydrotreated 950° F.+ Feed | Rapid Pyrolysis | Delay Coked |
|---|---|---|---|---|
| Products: | | | | |
| gas | | | 0.9 | 3.1 |
| liquid | | 100 | 93.2 | 80.9 |
| coke | | | 5.9 | 16.0 |
| gas | | | 0.9 | 3.1 |
| IBP–420° F. | | 3.5 | 2.7 | 21.7 |
| 420–650° F. | | 7.2 | 8.6 | 30.1 |
| 650–850° F. | | 12.7 | 22.2 | 27.8 |
| 850–1075° F. | | 8.3 | 11.3 | 1.3 |
| 1075° F.+ | | 68.2 | 48.3 | 0 |
| Coke | | | 5.9 | 16.0 |
| Liquid Analysis | | | | |

TABLE 3-continued

| ARAB HEAVY MEDIUM RESID BASED FEED | Arab Heavy Medium Resid | Arab Heavy Medium Hydrotreated 950° F.+ Feed | Rapid Pyrolysis | Delay Coked |
|---|---|---|---|---|
| % C | | 85.05 | | 87.11 |
| % H | 10.04 | 11.61 | | 12.93 |
| % N | 0.43 | 0.32 | | 0.054 |
| % O | 1.8 | | | 0.34 |
| % S | 4.5 | 0.73 | | 0.27 |
| ppm Ni | 45 | 16 | | — |
| ppm V | 150 | 27 | | — |
| % Asphaltenes | 21.3 | 21.3 | | |
| % CCR | 20.4 | 9.9 | | |
| Coke/CCR | | | 0.60 | 1.62 |
| Estimated: | | | | |
| Delay Coke Make | ~35 | | | |
| Fluid Coke Make | ~24 | | | |

The coke/CCR ratios are 1.7 and 2.0 for delayed coking before and after hydrotreating and 1.2 and 0.6 for rapid pyrolysis before and after hydrotreating. The results are shown in Table 4.

EXAMPLE 8

A Melones vacuum resid, having an atmospheric boiling point of 1075° F., a CCR of 18.3%, an asphaltene content of 25.5%, and 9.63% hydrogen content, is preheated to 600° F. at 100 psig and ejected through a ¼-inch wide slot onto the cylindrical surface of a 3-foot diameter drum being internally heated to 1250° F. The slot is parallel to the drum axis and 1.5 inch from the surface. The sheet of hot gas impinges upon the surface at an angle of 30° to the tangent along the line of impingement. The pyrolyzed gases, which are thermally cracked after a thermal contact time of less than 10 seconds, are cooled, condensed, measured, and analyzed, as in Example 1. The pyrolysis produces 17% coke and 80% liquid.

Another sample of the same resid is lightly hydrotreated to reduce the CCR to 10% with 1000 scf $H_2$/bbl of resid. The hydrotreated oil is then pyrolyzed by passing through the same slot onto the same hot drum. The pyrolysis produces 6% coke and 91% liquid.

It is important to note here that the purpose of mild hydrotreating is to increase the hydrogen content of the resid. Demetallation, although it does occur to some degree, is not necessary during the mild hydrotreating operation.

TABLE 4

| KUWAIT ATMOSPHERIC RESID BASED FEED | Kuwait Atmospheric Resid Feed | Kuwait Atmospheric Resid Hydrotreated | 850° F.+ Hydrotreated Kuwait Atmospheric Resid Bottoms Feed | Delay Coked | Rapid Pyrolysis |
|---|---|---|---|---|---|
| Products: | | | | | |
| gas | | | | ~ 3 | ~ 4 |
| liquid | | | | ~87 | ~93 |
| coke | | | | ~10 | ~ 3 |
| Liquid Analysis: | | | | | |
| % H | 11.6 | 12.5 | | | |
| S | 3.9 | 0.60 | | | |
| CCR | 8.0 | 3.40 | 5.0 | | |
| ppm Ni | 11 | 1.1 | 2.0 | | |
| V | 40 | 1.3 | 4.0 | | |

TABLE 4-continued

| KUWAIT ATMOSPHERIC RESID BASED FEED | | | | | |
|---|---|---|---|---|---|
| | | | 850° F.+ Hydrotreated Kuwait Atmospheric Resid Bottoms | | |
| | Kuwait Atmospheric Resid | | | Delay | Rapid |
| | Feed | Hydrotreated | Feed | Coked | Pyrolysis |
| % Asphaltenes | 4.0 | 1.5 | 2.5 | | |
| H-Consumption SCF/BBL | | 600 | | | |
| Estimated: | | | | | |
| Delay Coke Make | 13.6 | | | | |
| Fluid Coke Make | 9.6 | | | | |
| Delay Coke/CCR | 1.7 | | | 2.0 | |
| Fluid Coke/CCR | 1.2 | | | | 0.6 |

What is claimed is:

1. A process for producing high yields of liquid in the gasoline boiling range and low yields of coke from asphaltene-containing residual oil feed of approximate CCR and asphaltene varying from 2 to 30 weight percent, said low coke yields being measured by a coke/CCR ratio of 0.5 to 1.3, comprising:

A. lightly hydrotreating said residual oils over a hydrotreating catalyst, the mols of hydrogen added per mol of average resid being about 0.1–3.0, while minimizing the deposition of metal contaminants on said hydrotreating catalyst and concentrating said contaminants within said coke;

B. fractionating said lightly hydrotreated residual oils and removing a fraction boiling at at least 800° F. at atmospheric pressure; and C. thermally cracking said 800° F.+ fraction during a period of 1 to 10 seconds to produce said high yields of liquid and low yields of coke.

2. The process of claim 1, wherein said fraction boils at at least 850° F.

3. The process of claim 2, wherein said lightly hydrotreating further comprises passing hydrogen through said oils at a circulation rate of 1000 to 10,000 scf/bbl of said residual oils at 650° to 750° F. and an LHSV of 0.1 to 10.0.

4. The process of claim 3, wherein said lightly hydrotreating is performed at 750° F. and an LHSV of 0.3.

5. The process of claim 4, wherein the CCR of the lightly hydrotreated oils is 5–15%.

6. The process of claim 1, wherein said thermal cracking is performed by rapid pyrolysis at a coking temperature of 900° to 1100° F.

7. The process of claim 6, wherein the amount of said hydrogen added to said oil feed is from 200 to 1500 scf/bbl.

8. A process for upgrading residual oils to premium liquid products, comprising:

A. hydrotreating said residual oils at temperatures of 600° to 750° F. under a hydrogen pressure of 300 to 2,000 psi, an LHSV of 0.1 to 10, and a hydrogen circulation rate of about 1,000 to 10,000 scf/bbl of said residual oils, whereby an amount of hydrogen ranging from 200 to 1500 scf/bbl is added to said feed having an approximate CCR and asphaltene content varying from 2 to 30 weight percent;

B. fractionating said hydrotreated residual oils to produce a fraction boiling at at least 850° F.; and C. rapidly pyrolyzing said 850° F.+ fraction, by exposing said fraction to brief, short-time processing at high temperatures, so that thermal cracking occurs before or without substantial splitting off of hydrogen, thereby producing a minimum amount of coke and a maximum amount of liquid products that, although largely unsaturated, do not re-combine to produce hydrocarbons of heavier molecular weight, said minimum amount of coke being measured by a coke/CCR ratio within the range of 0.5 to 1.3.

9. The process of claim 8, wherein said coke/CCR ratio is within the range of 0.6 to 0.9.

* * * * *